United States Patent [19]

Conway

[11] Patent Number: 5,004,303

[45] Date of Patent: Apr. 2, 1991

[54] DISPLAY CASE

[76] Inventor: Joseph Conway, 50 Tower Rd., Newton, Mass. 02164

[21] Appl. No.: 468,181

[22] Filed: Jan. 22, 1990

[51] Int. Cl.[5] ..... A47F 3/00

[52] U.S. Cl. ..... 312/140; 312/258

[58] Field of Search ..... 312/257.1, 140, 258, 312/114

[56] References Cited

U.S. PATENT DOCUMENTS

| | | | |
|---|---|---|---|
| Re. 32,435 | 6/1987 | Carlstrom | 312/140 X |
| 729,148 | 5/1903 | Fabry | 312/140 X |
| 1,714,233 | 5/1929 | Morris | 312/140 |
| 3,169,810 | 2/1965 | Levy et al. | 312/140 X |
| 4,569,564 | 2/1986 | Ahmann | 312/258 X |
| 4,923,163 | 5/1990 | Harley | 312/140 X |

*Primary Examiner*—Joseph Falk

*Attorney, Agent, or Firm*—William Nitkin

[57] ABSTRACT

A portable display case having front, rear, top and first and second side members with a quickly fitted middle shelf adapted to be easily set up and retained together as a display case in a recess on top of a base and to be quickly dismantled and placed within a tote bag for transport and storage and, in a second embodiment where said display case's base includes a storage compartment, for storage and transport of all the members of said display case.

7 Claims, 4 Drawing Sheets

DISPLAY CASE

BACKGROUND OF THE INVENTION

1. Field of the Invention

The structure of this invention resides in the area of display cases and more particularly relates to a transparent display case which case can be dismantled and stored for easy transportation and which requires in its assembly no small separable parts.

2. Description of the Prior Art

Display cases are well known in the prior art. There are many users of display cases, for example, people who set up at trade shows, antique/collectible shows, flea markets, fairs, etc., who must carry their merchandise from show to show, setting up their display cases for a few hours or days before moving on to the next show. There are more than 29,000 trade shows held in the U.S. each year and countless antique and flea markets. These shows attract thousands of exhibitors and customers. Exhibitors wish to be able to set up their displays often in an expedited manner and to secure them from tampering and pilferage so that they can also take the opportunity to quickly examine what other exhibitors are selling should they wish to buy merchandise. Exhibitors also want their merchandise to be attractively displayed yet safe. When floor space is expensive, exhibitors wish the best display possible for limited selling space. Shabby display cases tend to lower the prices that people are willing to pay for items that if otherwise attractively displayed, might yield higher prices. Display cases of the prior art usually are in the form of fixed walled cases with a hinged glass or plastic top which lifts up so that objects can be placed in and/or removed therefrom. The tops of such display cases, when closed, can be locked so that the merchandise within the case can be displayed and viewed easily through the transparent top by those walking by. When a customer wishes to examine a piece of merchandise, he would request that the case be opened wherein the person displaying the merchandise would unlock the case and show the potential buyer the merchandise from the case. Such display cases are frequently heavy, difficult to transport and provide a limited amount of display area. Larger cases made of glass or other transparent material can provide additional shelves for the display of merchandise but it is difficult to move such cases as they are quite heavy and take up a great deal of space. To overcome the problem of cases taking up valuable space when transported, display cases that can be dismantled have been developed such as that disclosed in U.S. Pat. No. 4,553,680 to Griggs. In such a display case the top and sides can be separated from one another and the case, once dismantled, is collapsible, taking up much less space. Another display case of knock-down construction is disclosed in U.S. Pat. No. 4,002,233 to Page and is of the type having a pivotal top. Another display case having sides that dismantle is seen in U.S. Pat. No. 734,644 to Wilton which sides can be stored within the base of the case for transport, such case, though, being of rather complex and heavy construction.

SUMMARY OF THE INVENTION

It is an object of this invention to provide an improved and highly portable display case which can be quickly set up, dismantled and stored within its base, which base then acts as a carrying case or, in another embodiment, stored as components in a hand tote bag.

It is another object of this invention that the case be able to be set up and dismantled without the use of small separable parts such as screws, nuts or bolts. The case of this invention is of a design that is economical and easy to manufacture and which provides speed and great simplicity of assembly as well as providing great accessibility to merchandise within the case.

It is a further object of this invention that the merchandise contained within the display case be very accessible, be illuminated with a minimum of light, and that the area within the case be visible from all sides so that all of the areas in the display case be usable for display of its contents.

It is a still further object of this invention that the case be strong enough so that a heavy object could be displayed on top of the unit without danger of breaking the display case.

The display case of this invention is attractive in appearance and of appropriate size and quality for the display and enhancement of fine or expensive merchandise. The display case of this invention can be set up and dismantled quickly and easily without tools or accessories even by those who lack dexterity. The display case can be secured by locking means to protect valuable items displayed therein.

The display case of this invention in one embodiment includes a storage case and front, rear and first and second side elements all of which are attached to a top member. The rear element of the display case can have doors that can be locked. The case can be made of a clear acrylic plastic, such as lucite SAR but it should be understood that the case could be made of any equivalent sturdy transparent material such as glass or other plastic material. Plastic has some advantages in that it is much lighter than glass and has far less chance of breaking during use, set-up and dismantling. The display case, in one embodiment, can include lighting means and also can plug into an electric power socket and have multiple outlets on the side thereof or such lights can be battery-operated.

In the embodiment where the base of the display case forms the top of the storage case, such storage case contains storage compartments in which the sides, top, front and rear elements of the display case can be slid within slots when the display case is knocked down in its carrying mode. There is a recess formed in one side of the storage case which recess can be faced upwards when the storage case is placed on the surface on which the display case is to be set up. The recess is rectangular in shape and forms the base of the display case. The sides, front and rear elements, as described further below, are attached to the sides of the recess. Channel members retain the sides, front and rear elements together, and a top is also affixed and retained to the display case. One or more shelves can also be provided. Doors in the rear side are provided so that the user can quickly and easily gain access to the interior of the display case. Such doors are secured with locks to prevent any theft of merchandise held within the display case and designed to open outwards to block access to anyone reaching around the sides from the front of the case to try to gain access to the interior of the case. The front, side and rear elements at their bottoms have retention means to be engaged with the sides of the recess in the base. In one embodiment such retention means are in the form of apertures defined at the bottoms of the sides and front and rear members which apertures may be reinforced with teflon, nylon grommets or equivalent means. Extending from the sides of the recess are mating protrusions such that when the side, front and rear elements are placed into the recess and then moved laterally outward against the sides of the recess, the protrusions mate into the apertures defined in the bottom of the sides, front and rear elements and once locked into position by locking means will thereby engage the sides, front and rear elements in a secure manner. Locking means can be attached to the bottom of the recess in the base which can be positioned against the sides, front and rear elements to prevent any inward movement of the sides, front or rear elements so that they cannot be released from the protrusions extending from the sides of the recess. In an alternate embodiment the sides of the recess can have channels formed therein and the sides, front and rear elements can have mating protrusions at their bottoms which engage into the channels. Various other locking means are described further below.

The edges of the front, sides, rear and top elements interlock together by edge moldings having slots provided at right angles therein which moldings allow the front, rear and side elements to be positioned therein with their edges engaged within the slots of the moldings. A molding can also be provided for a shelf in the display case so that it can be engaged within slots or can rest on top of protrusions which are adhered to the inside of the front, rear and side elements. A wedge-like lock protrusion disposed around the edges of the shelf can engage onto protruding members inside the front, rear and side elements to retain a shelf securely in position..

In the embodiment where the base includes a storage case, such case can have a releasable top lid which when removed, exposes the front, rear and side elements in their retention slots and other elements in the storage case. The storage case's releasable lid can have a handle which, in one embodiment, can be recessed within its top to be out of the way when positioned therein so that when the case is stored, the handle will not protrude and the top of the storage case lid will form a flat surface. There can be a locking assembly provided for holding the case top lid to the storage case and when the case is in a lateral position on its side with the recess in the storage case defined in the opposite side facing upwards, a plurality of parallel slots can be provided on two opposite lateral inner sides of the openings in the storage case so that the front, rear and side elements of the display case can be slid within these slots and held securely within the storage case. These slots for the front, rear and side elements and other display case components can be molded in the opposite lateral sides of the opening in the storage case or otherwise formed and bonded to the inside of the storage case or provided by other equivalent means. The storage case can be made of plastic or other equivalent strong material and the arrangement of the slots as described further below assists in the compact and efficient storage of all the component parts of the display case. In addition to providing storage of the component parts of the display case, the storage case can have a storage drawer for storage of other items such as price tags, pencils, receipt hooks, and the like.

In the other embodiment, the display case base can have a base with the recess and side retention means as described above but such base does not include storage means for the component parts of the display case. The base can be supported on four detachable legs and the dismantled display case and base can be stored and carried in a tote bag.

The display case of this invention can be set up or dismantled in under two minutes. The display case is highly portable and could be carried on airplanes or shipped as luggage. The display case has standardized and replaceable components so that if any part should be damaged or broken, such part could be easily replaced. The front, rear and side elements should be scratch-resistant, lightweight and transparent to fully and advantageously display the merchandise contained therein. Further, the design of the display case with locking means eliminates theft of items stored therein even at trade shows where the display case may be left unattended at times or even overnight. The door locks are adapted to be secure so that the case cannot be disassembled without the key to unlock the case which feature protects the merchandise contained in the display case.

DESCRIPTION OF THE PREFERRED EMBODIMENT(S)

Figure 1:
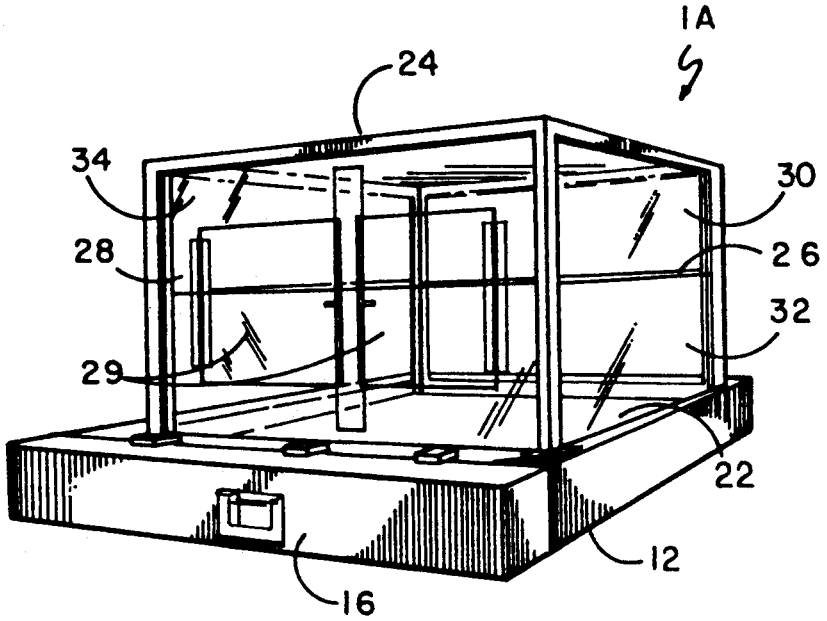
FIG. 1 is a perspective view of the display case of this invention set up on top of its storage case.

FIG. 1 illustrates a perspective view of display case 10 of this invention of the embodiment wherein the display case is stored within the storage case which forms the display case's base, such display case set up on storage case 12 with recess 22 seen in the upwards facing side of storage case 12. Right side element 32 and left side element 34 are set up engaged with front element 30, rear element 28 with top element 24 in place. These members are all interconnected by edge moldings as will be described further below. Rear element 28 has lockable doors 29.

Figure 2:
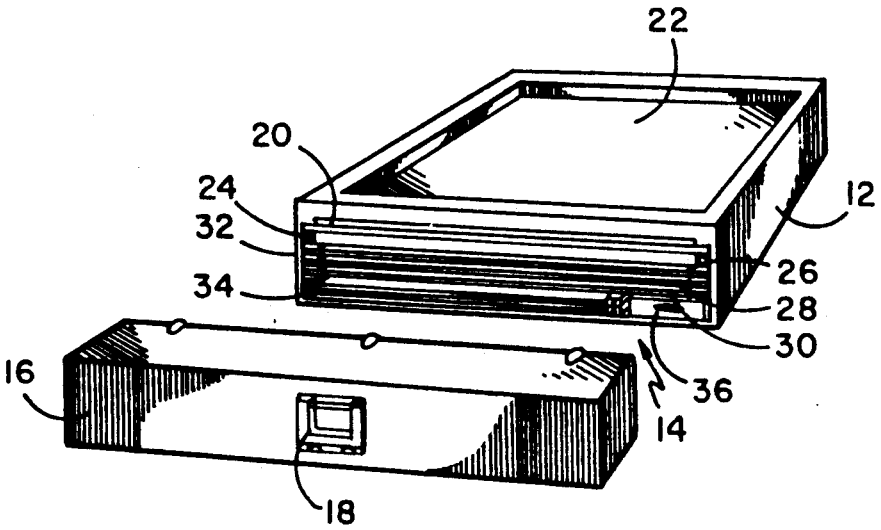
FIG. 2 is a perspective view of the storage case of this invention with its lid separated therefrom with the side, front, rear and top elements of the display case within the storage case ready to be either set up or covered by the lid.

In FIG. 2 the display case has been dismantled with the elements pulled apart from the edge moldings which are permanently affixed to the sides of the left and right side elements 34 and 32 and top element 24 so that when the side elements are positioned in recess 22, front element 30 and rear element 28 can be slid downward into the slots in the edge moldings affixed to the sides of the left and right side elements and the top element then can be engaged into the front, rear, and side elements. The elements are stored in opening 14 as seen in FIG. 2 with lid 16 detached and moved away displaying how the elements are stored. Handle 18 on lid 16 is shown recessed. The elements are stored within channels formed in the lateral sides of opening 14 such as side elements 32 and 34 held together within the lower channels of the storage case. Front element 30 can be held within the channel above the channel holding side elements 32 and 34. Rear element 28 complete with its doors is slid in the channel next above, and in the next above channel shelf member 26 is slid. Top element 24 is slid into position in the channel above that. On a shelf above the top element can be positioned a velvet covered pad which can be easily installed inside recess 22 once the sides and front panel of the display case are set up.

Figure 3:
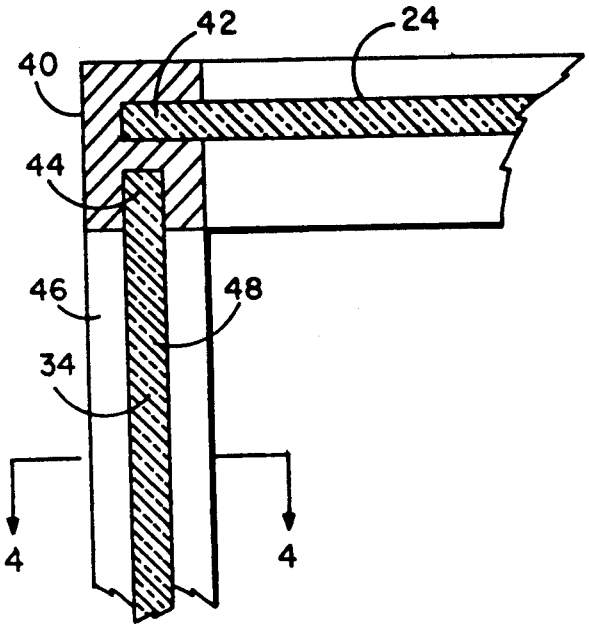
FIG. 3 illustrates a sectional cutaway view of the edge molding showing the slots therein retaining the top element to the side element.
Figure 4:
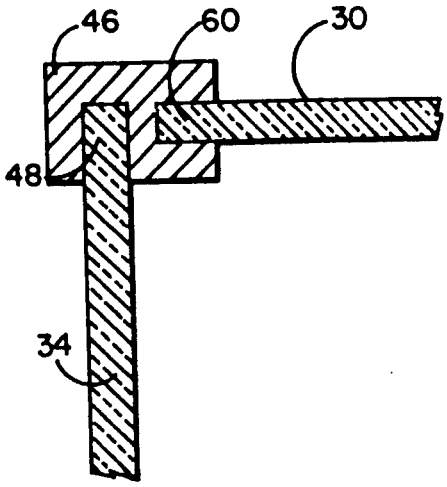
FIG. 4 illustrates a sectional view through 4—4 of FIG. 3 of the edge molding that retains the front element to the side element.

In FIG. 3 one can see a sectional view of edge molding 40 showing top element 24 which is retained in edge molding 40 in upper slot 42. Edge molding 40 can be affixed by permanent adhesive means to top element 24. Side element 34, for example, can be positioned within the downwardly extending lower slot 44 of first edge molding 40 which side 34 has attached thereto extending along its side second edge molding 46 which has a slot therein seen in FIG. 4 for the receipt of the side of the front or rear member. If one takes a section through 4—4 of FIG. 3, one can see in FIG. 4 a view where left side element 34 is engaged within second slot 48 within second edge molding 46 which also has a perpendicular slot 60 receiving, for example, front element 30. In this way the top and side elements and front and rear elements fit together for retention in a rectangular shape. The components are further strengthened by the edge moldings to be self-supporting and will not bend or crack at the edges when weight is placed thereon. The goal achieved in this design of a lightweight display case which is easily transportable is further accomplished when the elements together weigh less than 70 lbs so that the structure can be transported without exceeding weight limits such as in airline travel and so that the structure could be carried by one individual.

Along the inner sides of the side, front and rear elements can be positioned catch members midway up or at any level desired for shelf retention. Although more shelves could be used, one shelf member, for example shelf member 26 seen in FIG. 1 can be positioned inside the display case and allowed to drop down so that its edges which have engagement means engage into catch means disposed along the insides of the display case.

Figure 5:
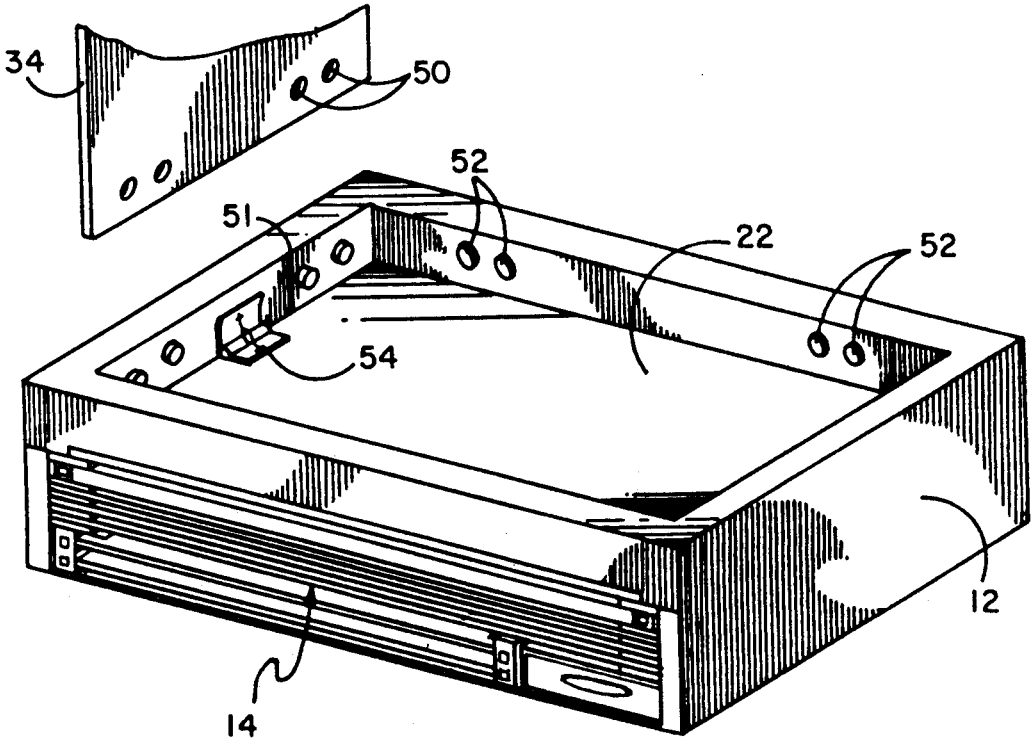
FIG. 5 illustrates a perspective view of the recess defined in the side of the storage case of this invention with a portion of a side element displayed thereabove showing the engagement protrusions extending from the sides of the recess and a retention mechanism to retain a element in position against the side of the recess.

In FIG. 5 can be seen storage case 12 with the elements of the display case dismantled and stored in the storage case. A second depiction of a portion of left side element 34 is shown disposed above recess 22. In this view one can see that there are a series of protrusions 52 extending inward from the sides 51 of recess 22. A series of mating apertures 50 are defined in the bottom of left side element 34 for receipt of protrusions 52. The front, right side and rear elements have similar apertures which will mate into similar protrusions along the sides of the recess that they are positioned against. In practice one fits the left side element 34 downward putting apertures 50 in front of protrusions 52 and then moves the side outwardly against side 51 of recess 22 so that protrusions 52 engage into apertures 50. One then utilizes spring-operated locking mechanism 54 which is adjusted to then push outwardly against left side element 34 thereby retaining it on protrusions 52 until the locking mechanism is manually released from inside the display case.

Figure 6:
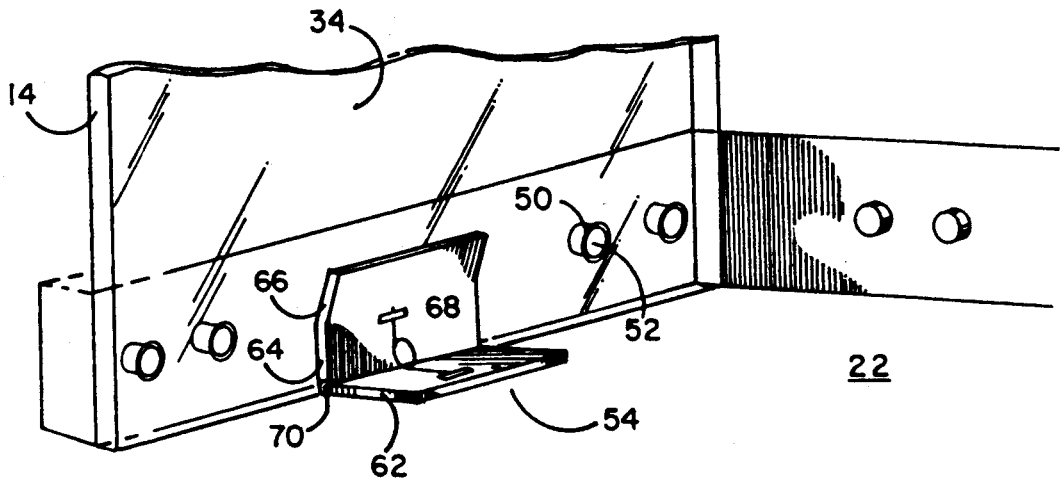
FIG. 6 illustrates an enlarged sectional view of a portion of FIG. 5 with the apertures of a side element in mated position with the protrusions extending from the side of the recess with the locking mechanism holding the side element in place.

FIG. 6 illustrates an enlarged view of spring-operated locking mechanism 54 within recess 22. Left side element 34 has apertures 50 at its bottom which fit onto protrusions 52 extending from the side of recess 22.

In FIG. 6 base member 62 the of locking mechanism is affixed to the bottom of recess 22. Hinge 70 joins base member 62 to upper hinged member 64 which extends upwards with a portion 66 of upper hinged member 64 extending away from left side element 34 which can be used as a grasping handle to release the locking mechanism. Spring member 68 is adapted to always push upper hinged member 64 away from base member 62, thereby pressing portion 64 against the inside of left side element 34 holding it in position until one grasps inwardly extending portion 66 of upper hinged member 64, pushing it downward thereby allowing left side element 34 to be pulled inward off protrusions 52, thereby releasing it. It should be noted that other locking and engagement mechanisms can be utilized in the device of this invention.

Figure 7:
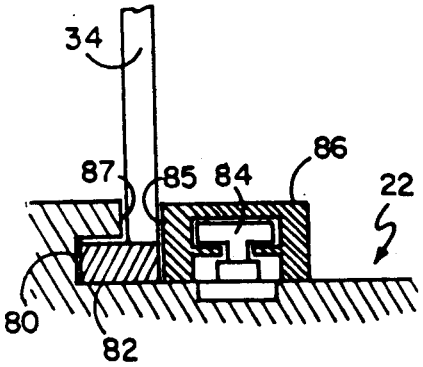
FIG. 7 illustrates a side sectional view of an alternate method of side element retention where a channel is formed within the bottom of the side of the recess for engagement of a mating protrusion on the bottom of the side element and a locking mechanism holding the side element in place.

Other retention and locking mechanisms can be seen in FIG. 7 which shows one side of recess 22 having channel 80 defined therein and the base of left side element 34, used only as an example of the bases of all the elements, can have a member formed as part thereof or affixed thereto which extends outwardly being protrusion member 82 which is adapted to mate into channel 80 formed within the side of recess 22. One can lock the side element in place by providing a T-shaped element 84 affixed to the bottom of recess 22 on which a mating slide member 86 can be slid from the end of protruding T-shaped element 84. T-shaped element 84 does not extend all the way from edge to edge of the side of the recess. Slide member 86 is just placed adjacent to the T-shaped member and then slid into position on it with its side 85 adjacent to left side element 34 so that left side element 34 can no longer move laterally inward away from side 87 of the recess. Left side element 34 is thus held in place as the other elements of the display case would similarly be held.

Figure 8:
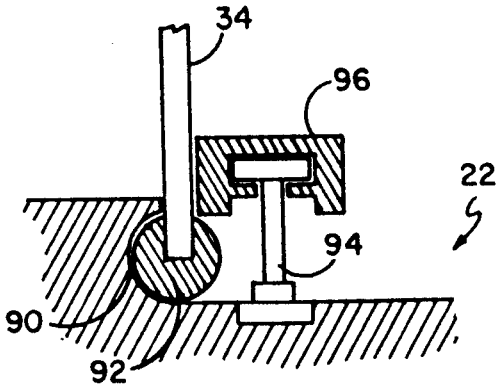
FIG. 8 illustrates another alternate method of side element retention where the channel in the side of the recess is rounded and the side element has a mating round member at its bottom which mates with the rounded channel in the side of the recess with a locking mechanism holding the side element in place.

FIG. 8 illustrates an alternate embodiment of a retention and a locking mechanism where channel 90 formed in the edge of recess 22 is inwardly curved in shape and rounded member 92 is affixed to the base of left side element 34. T-shaped mount 94 can be affixed to the base of recess 22 but extends further up than that shown in FIG. 7 so that when locking member 96 is slid onto it, locking member 96 will engage against left side element 34 above the curvature of rounded member 92. This alternative locking structure works similarly to the structure illustrated in FIG. 7.

Figure 9:
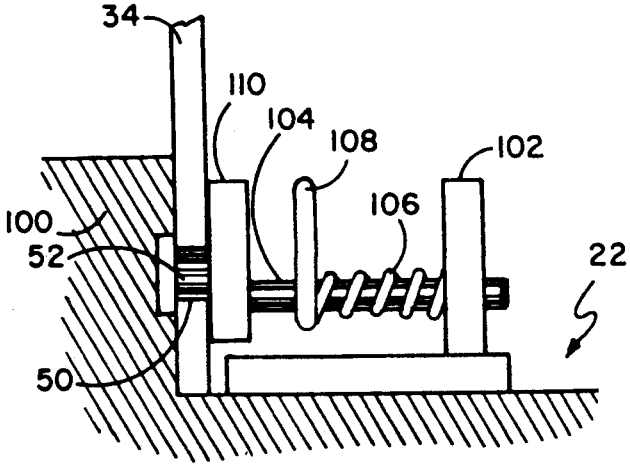
FIG. 9 illustrates an alternate side element locking means with the side element retained with its aperture around a protrusion in the side of the recess with a locking mechanism utilizing a spring-moved member which urges the side element against the side of the recess.

In FIG. 9 can be seen an alternative locking mechanism where left side element 34 is held, such as shown in FIGS. 5 and 6, by having protrusion 52 fit within aperture 50 formed within left side element 34. The locking member is pusher member 110 mounted on shaft 104 forced by spring 106 from upright member 102 which is affixed to the bottom of recess 22. Thus the force of the spring 106 urging pusher member 110 against the side, front and rear elements holds them in place. Release handle 108 can be attached to shaft 104 to allow for easy grasping and pulling back of pusher member 110 compressing spring 106 with shaft 104 passing through an aperture formed in upright member 102 thereby moving pusher member 110 away from left side element 34 allowing left side element 34 to be moved inwardly and off protrusion 52 to allow it to be removed from the recess in the storage case.

Figure 10:
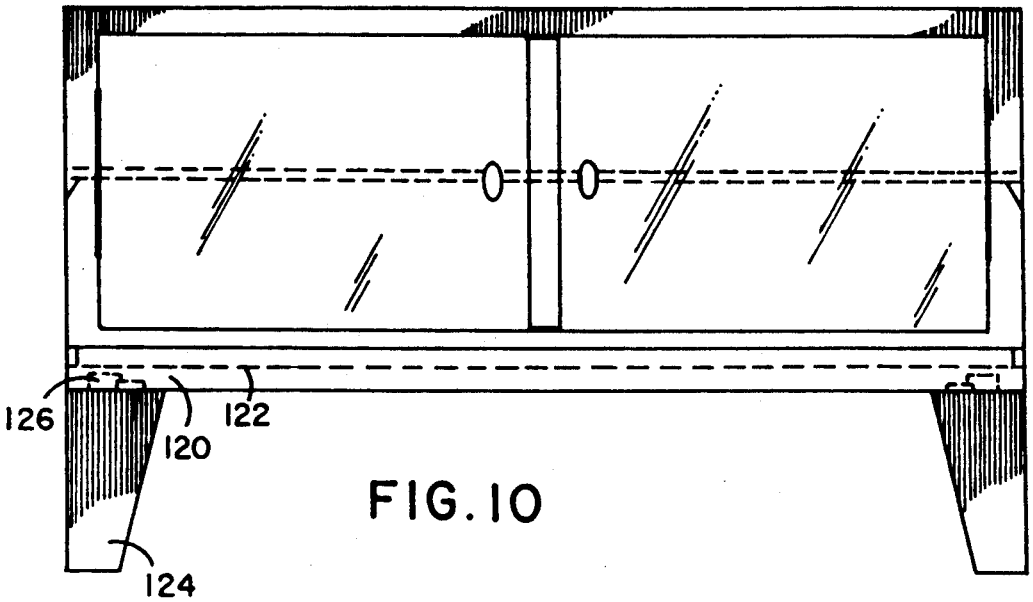
FIG. 10 illustrates an alternate embodiment of the display case wherein base does not contain storage compartments.
Figure 11:
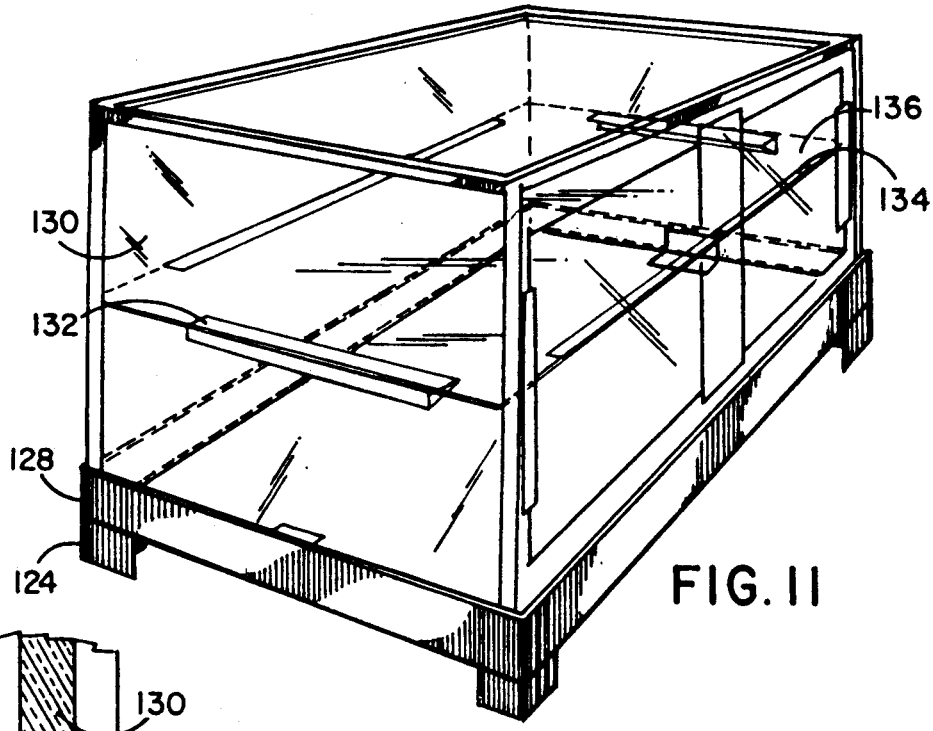
FIG. 11 illustrates a perspective view of the type of case shown in FIG. 10.
Figure 12:
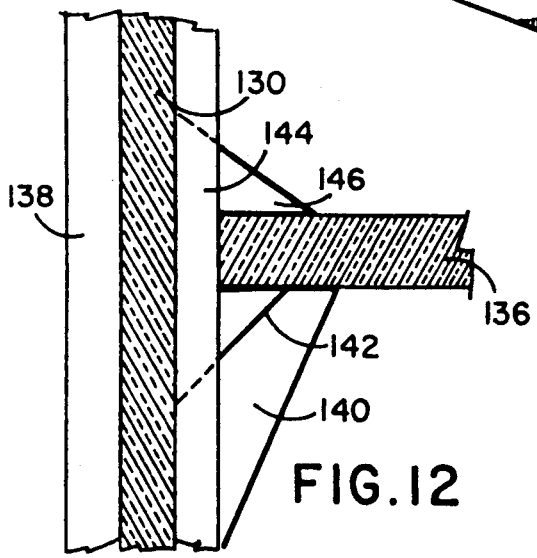
FIG. 12 illustrates an enlarged side elevational sectional view of the shelf support structure.
Figure 13:
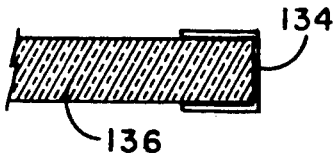
FIG. 13 illustrates a cross-sectional view through a section of the rear of the shelf showing its reinforcement support member.

As mentioned above, the display case of this invention has a second embodiment wherein the base of the display case is not part of the storage case but instead is a substantially planar member with a similar recess for retaining the front, rear and sides as in the embodiment disclosed above. Base 120, though, as seen in FIG. 10 having recess 122 defined therein, does not have a lower storage compartment but can include apertures 126 at each of its four corners to receive interlocking protrusions extending from legs 124. For storage this structure is disassembled as described above and carried within a tote bag. Around the sides of the base can be disposed velcro strips over which can be applied decorative skirting members 128 as seen in FIG. 11 which have mating velcro on their inside surfaces which can be pressed against the velcro around base 120. Shelf 136 can be removably retained within the sides by having an upwardly extending shelf retention member 140 as seen in FIG. 12 from side 130 which shelf retention member 140 has an inward and downwardly disposed upper surface 142. Shelf 136 can have positioned on its end a generally triangular-shaped member 144 which has a shelf receipt aperture 146 defined therein. The sides of this triangular-shaped member 144 can be at an angle to mate against the downwardly angled upper surface 142 of shelf retention member 140. Shelf 136 is slid downward from the open top of the case during assembly and either side of triangular-shaped members 144 disposed at both ends of shelf 136 can mate against and be retained by shelf retention member 140. Shelf member 136, being of a generally thin planar plastic, might have a tendency to sag at its middle but this situation is avoided by having positioned (hereon a reinforcing U-shaped channel 134 on the front and back thereof one of which is seen in end view in FIG. 13. The triangular-shaped member 144 wedges the shelf securely against the shelf retention member 140 while the U-shaped edge molding prevents sagging near the center of the shelf.

It should be noted that the size of the display and storage cases can be of any desired dimension and size. The storage and display cases can be in any rectangular shape, whether it be higher or lower and can be provided with any number of shelves.

It should be further noted that a power supply can be provided within the display case of this invention although such power supply is not illustrated since it is an additional feature. Fluorescent lamps could be attached by hooks to the top of the display case which feature may be desirable for some display facilities. In some embodiments legs can be affixed to the downward facing side of the storage case when in its display mode which legs can be rubber buttons or which could be longer legs which would raise the case several inches off the table which legs can fit within slots formed in the storage case when the structure is in its display mode.

Although the present invention has been described with reference to particular embodiments, it will be apparent to those skilled in the art that variations and modifications can be substituted therefor without departing from the principles and spirit of the invention.

I claim:

1. A case comprising:

a display case portion having a top and side elements having tops and bottoms including channel members to retain such members together set up in a closed structure such elements adapted to be dismantled;

at least one door located within on one of said elements;

a storage case having a top, bottom and sides with an opening defined therein on one of said sides;

said storage case adapted to receive and contain said dismantled top and side elements when each is positioned therein;

said storage case further including a recess defined in its top, said recess having sides, said recess, when facing upwards, forming a base for said display case elements;

means for retaining the bottoms of said side elements to the sides of said recess for retention of said side elements when in their set-up mode;

wherein said retaining means include:

retaining members to hold the bottoms of said side elements against the sides of said recess, said retaining members including a plurality of protrusions extending from the sides of said recess and a plurality of mating apertures defined in the bottoms of said side elements, said apertures adapted to receive said protrusions;

locking means which are adapted to be positioned against the bottoms of said side elements, said locking means adapted to hold sides against the sides of said recess and said protrusions within said apertures to lock said side elements in place;

wherein said locking means comprises a plurality of structures, each adjacent said front, rear, and first and second side elements, said structure including:

a first member affixed to the base of said recess;

a second member hingeably attached to said first member;

a spring member urging said first member away from said second member; and said second member adapted to be depressable to a downward non-engaging position and when released, to be forced by said spring against said front, rear and first and second side elements depending upon said locking means' position in said recess.

2.

a case comprising:

a display case having a top and side elements having tops and bottoms including channel members to retain such members together set up in a closed structure such elements adapted to be dismantled;

at least one door located within on one of said elements;

a base having a top and bottom;

said base further including a recess defined in its top, said recess having sides;

means for retaining the bottoms of said side elements to the sides of said recess for retention of said side elements when in their set-up mode;

wherein said retaining means include:

retaining members to hold the bottoms of said side elements against the sides of said recess, said retaining members including a plurality of protrusions extending from the sides of said recess and a plurality of mating apertures defined in the bottoms of said side elements, said apertures adapted to receive said protrusions;

locking means which are adapted to be positioned against the bottoms of said side elements, said locking means adapted to hold sides against the sides of said recess and said protrusions within said apertures to lock said side elements in place;

wherein said locking means comprises a plurality of structures, each adjacent said front, rear, and first and second side elements, said structure including;

a first member affixed to the base of said recess;

a second member hingeably attached to said first member;

a spring member urging said first member away from said second member; and said second member adapted to be depressable to a downward non-engaging position and when released, to be forced by said spring against said front, rear, and first and second side elements depending upon said locking means' position in said recess.

3. The structure of claim 1 wherein said retaining means include:

a pusher member;

a shaft affixed at one end to said pusher member;

a support member affixed to the bottom of said recess with an aperture defined therein receiving said shaft;

a spring member engaged between said pusher member and said support member adapted to urge said pusher member against said front, rear, and first and second side elements against which said retaining means are adjacent; and release means to pull said pusher member away from said front, rear, and first and second side elements so as to release pressure against 4. A case comprising:

a display case portion having a top and side elements having tops and bottoms including channel members to retain such members together set up in a closed structure such elements adapted to be dismantled;

at least one door located within on one of said elements;

a storage case having a top, bottom and sides with an opening defined therein on one of said sides;

said storage case adapted to receive and contain said dismantled top and side elements when each is positioned therein;

said storage case further including a recess defined in its top, said recess having sides, said recess, when facing upwards, forming a base for said display case elements;

means for retaining the bottoms of said side elements to the sides of said recess for retention of said side elements when in their set-up mode;

wherein said side elements include front, rear and first and second side elements, wherein said locking means include:

a T-shaped member extending from the bottom of said recess; and a slide member adapted to slide onto said T-shaped member with a portion of said slide member then being adjacent to said adjacent front, rear, or first and second side elements.

5. The structure of claim 1 wherein said locking means include:

A T-shaped member extending from the bottom of said recess; and a slide member adapted to slide onto said T-shaped member with a portion of said slide member then being adjacent to said adjacent front, rear, or first and second side elements.

6. The structure of claim 1, 2 or 4 further including:

at least one shelf member; and means to retain said shelf member horizontally disposed in said display case.

7. The structure of claim 6 further including:

a support member having an inwardly downward angled upper surface a triangular member disposed at each end of said shelf to mate with the upper surface of said support member; and a U-shaped support member fitted onto the front and rear of said shelf to reinforce said shelf to prevent sagging in the center thereof.

* * * * *